US011191991B2

(12) United States Patent
Parent et al.

(10) Patent No.: US 11,191,991 B2
(45) Date of Patent: Dec. 7, 2021

(54) RUNNING TRAINING BAND

(71) Applicants: James Parent, Mount Pleasant, MI (US); Bill Duddles, Mount Pleasant, MI (US); Carrie Spender, Mount Pleasant, MI (US)

(72) Inventors: James Parent, Mount Pleasant, MI (US); Bill Duddles, Mount Pleasant, MI (US); Carrie Spender, Mount Pleasant, MI (US)

( * ) Notice: Subject to any disclaimer, the term of this patent is extended or adjusted under 35 U.S.C. 154(b) by 0 days.

(21) Appl. No.: 16/781,469

(22) Filed: Feb. 4, 2020

(65) Prior Publication Data

US 2020/0246654 A1 Aug. 6, 2020

Related U.S. Application Data

(60) Provisional application No. 62/801,447, filed on Feb. 5, 2019.

(51) Int. Cl.
*A63B 21/055* (2006.01)
*A63B 21/04* (2006.01)

(52) U.S. Cl.
CPC ..... *A63B 21/0555* (2013.01); *A63B 21/0421* (2013.01); *A63B 21/0557* (2013.01)

(58) Field of Classification Search
CPC ..... A63B 21/02; A63B 21/04–0435; A63B 21/055–0557; A63B 21/4017–4025; A63B 69/0028; A63B 69/0059
See application file for complete search history.

(56) References Cited

U.S. PATENT DOCUMENTS

| | | | | |
|---|---|---|---|---|
| 7,491,186 | B2 * | 2/2009 | Zeide | A61F 5/013 602/20 |
| 2003/0004018 | A1 * | 1/2003 | Burns | A63B 69/0002 473/458 |
| 2011/0111930 | A1 * | 5/2011 | Byrd | A63B 69/0059 482/121 |

* cited by examiner

*Primary Examiner* — Jennifer Robertson
(74) *Attorney, Agent, or Firm* — Dale J. Ream

(57) ABSTRACT

An arm training band includes a strap having an elongate configuration and a pair of opposed loops coupled to opposite ends of the strap. The loops are specifically configured to fit or hook over a thumb of a user who is wearing the arm training band. The strap may be extended around the upper arm of the user proximate the user's elbow and the loops hooked over the user's thumb. Preferably, the user will wear an arm training band on each arm when training and practicing proper arm positioning when running.

5 Claims, 2 Drawing Sheets

RUNNING TRAINING BAND

REFERENCE TO RELATED APPLICATIONS

This application claims the priority of provisional patent application U.S. Ser. No. 62/801,447 filed Feb. 5, 2019 titled RUNNING TRAINING BAND and which is incorporated herein by reference in its entirety.

BACKGROUND OF THE INVENTION

The present invention relates generally to sports training equipment and, more particularly, to a running training band that straps to a user's hand and elbow in a manner in which failure to keep the arm bent at about 90 degrees results in the strap disconnecting.

Often times, a young athlete fails to learn and practice proper posture and form for running. Specifically, it is agreed amongst experts that the arms are just as important as the legs when running. Proper arm posture and arm swing drives the legs and establishes a natural gait. However, just "hearing" reminders to keep the arms bent at 90 degrees while running has proven to be insufficient in some people to establish a proper habit.

Therefore, it would be desirable to have an arm band that connects the thumb and elbow of a user so as to mandate a 90 degree bend of the arm while running. Further, it would be desirable to have an arm band having an elongate strap that may be wrapped around the user's elbow and having a pair of opposed loops that may be connected to the user's thumb.

SUMMARY OF THE INVENTION

An arm training band according to the present invention includes a strap having an elongate configuration and a pair of opposed loops coupled to opposite ends of the strap. The loops are specifically configured to fit or hook over a thumb of a user who is wearing the arm training band. The strap may be extended around the upper arm of the user proximate the user's elbow and the loops hooked over the user's thumb. Preferably, the user will wear an arm training band on each arm when training and practicing proper arm positioning when running.

Therefore, a general object of this invention is to provide an arm training band having an elongate strap that wraps around a user's arm proximate his elbow and having a pair of opposed loops that may be hooked onto the user's thumbs.

Another object of this invention is to provide an arm training band, as aforesaid, that disconnects automatically from the user's elbow if the user's arms are not maintained at a 90 degree bend.

Still another object of this invention is to provide an arm training band, as aforesaid, that is length adjustable.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
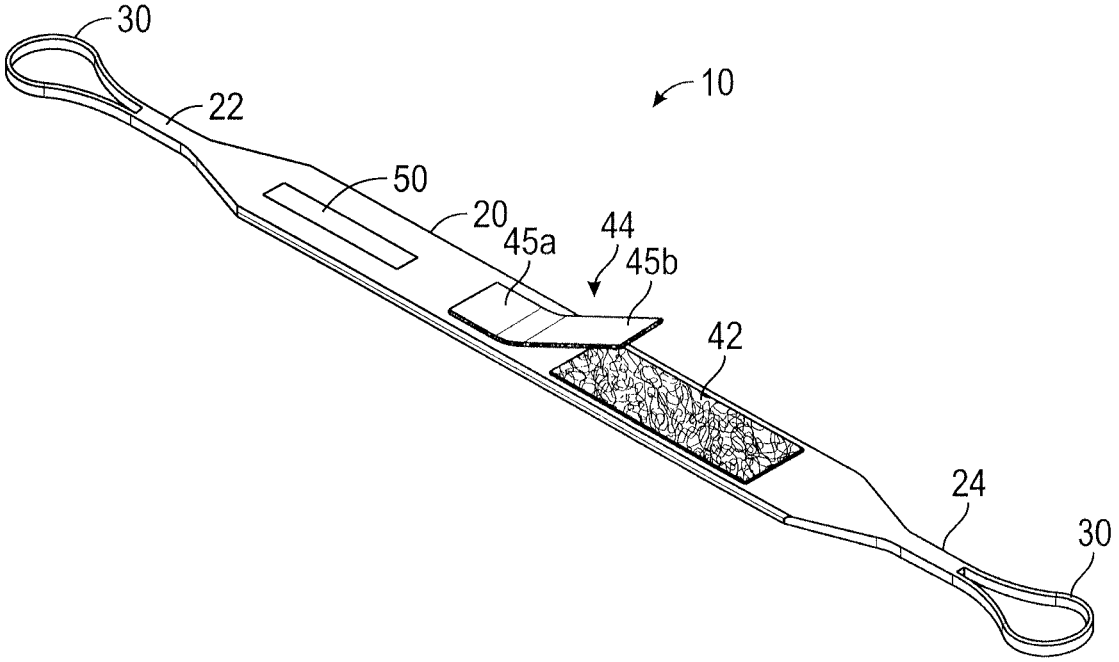
FIG. 1*a* is a perspective view of an arm training band according to a preferred embodiment of the present invention, illustrated with a length adjustment assembly in one configuration.
Figure 1B:
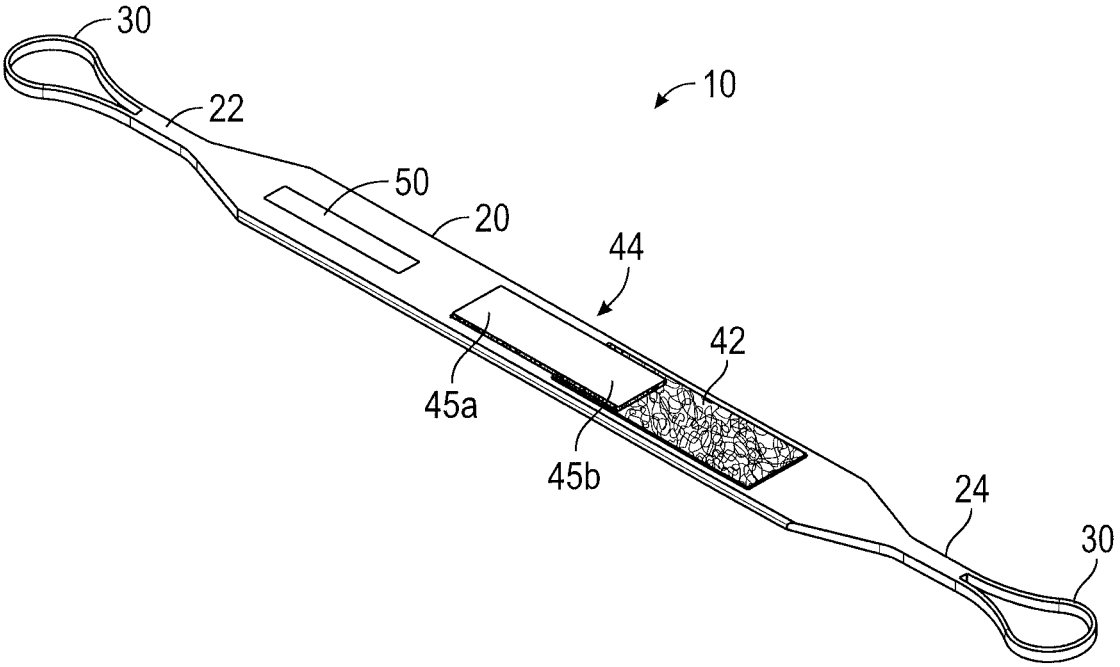
FIG. 1*b* is a perspective view of an arm training band as in FIG. 1*a*, illustrated with the length adjustment assembly in another configuration.
Figure 2:
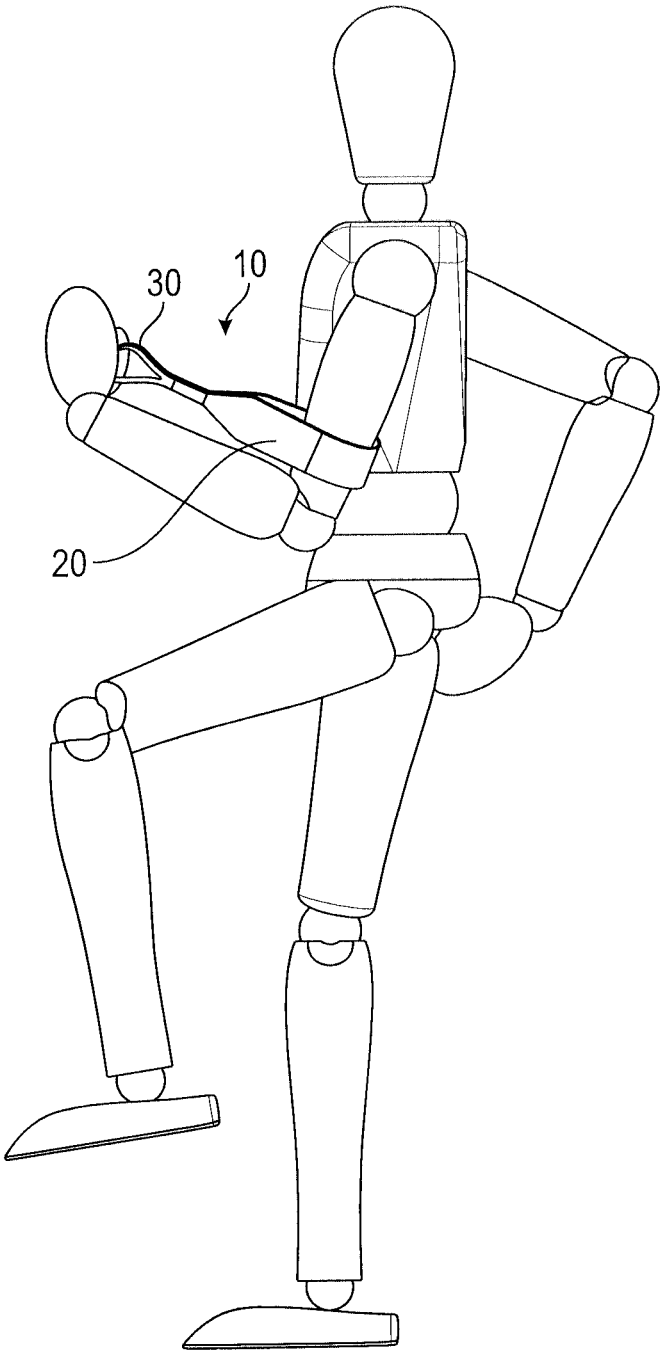
FIG. 2 is a perspective view of the arm training band in use on a caricature of a human user.

An arm training hand according to a preferred embodiment of the present invention will now be described in detail with reference to FIGS. 1*a* to 2 of the accompanying drawings. The arm training band 10 includes an elongate strap 20 and a pair of loops 30*a* and 30*h* attached to opposed ends of die strap 20.

The strap 20 of the arm training band 10 includes opposed first 22 and second 24 ends and has an elongate configuration. The strap 20 may be constructed of a fabric, nylon, or elastic material having a thin construction and a width that allows the strap 20 to wrap comfortably around the upper arm of a user proximate the elbow but which also falls therefrom when the arms are no long bent appropriately. The width of the strap 20 may include transitional areas that taper downwardly toward the loops 30, respectively.

Each loop 30 is connected to respective ends of the strap 20. In an embodiment, the strap 20 and loops 30 may have a unitary construction although, in other embodiments the strap 20 and loops 30 may be constructed of different materials and be coupled together. Specifically, the loops 30 may be constructed of an elastic material, such as rubber bands so as to accommodate different sized thumbs.

In another aspect, the strap 20 may be length adjustable so that the arm training band 10 may be used by persons of different arm sizes. Specifically, a length adjustment assembly is situated on the front side of the strap 20 and configured to be selectively released and then adjusted by stretching the strap 20 and then securing the length adjustment assembly at the adjusted length (FIGS. 1*a* and 1*b*). Explained in even more detail, the strap 20 may include a first length adjustment portion 42 and a second length adjustment portion 44 that may be selectively and releasably coupled together at an adjusted length. Each adjustment member may be constructed of hook and loop material. For instance, the first adjustment portion 42 is fixedly attached to the front side of the strap 20 and is constructed of loop material. The second adjustment portion 44 includes a first section 45*a* fixedly attached to the front side of the strap adjacent to the first adjustment portion 44 and a second section 45*b* having a proximal edge pivotally coupled to the first section 45*a* and having a bottom side constructed of a hook material. The second section 45*b* is pivotally movable between an adjustment configuration in which the second section is displaced from the first adjustment portion 42 and a deployed configuration mated to the first adjustment portion 42. It is understood that length adjustment of the strap 20 requires that the second section 45*b* be released to the adjustment configuration at which circumstance the strap 20 may be stretched or lengthened or, conversely, be allowed to shrink to its at-rest configuration. Then, the second section 45*b* is mated again to the first adjustment portion 42.

In still another aspect, the strap 20 may include indicia 50 imprinted on at least one side of the strap 20 such as advertising, fundraising identifiers, a QR code, or other text or images.

In use, the running training band 10 is put on or donned onto the body of a runner in a manner similar to putting on training gear or apparel. Specifically, a user inserts on thumb of a hand through the first loop of the strap 20, i.e. so the loop "captures" the thumb. Similarly, the strap 20 is extended, such as by stretching, over the user's elbow and positioned on the upper arm. It is understood that the running training band 10 will only stay in this position so long as the user runs while the arm stays in a generally perpendicular bend configuration, Otherwise, the running training band 10 will slip off and be a reminder or indicator to the user that proper running form was not maintained.

It is understood that while certain forms of this invention have been illustrated and described, it is not limited thereto except insofar as such limitations are included in the following claims and allowable functional equivalents thereof.

The invention claimed is:

1. A method for using a physical therapy band for training a person having a thumb and an elbow, said method comprising:

providing a strap having a first end and a second end opposite said first end, said strap having an elongate configuration;

insert a thumb of a person's hand through a first loop member attached to said first end of said strap;

insert an elbow of the person's arm through a second loop member attached to said second end of said strap; and changing a length of the strap using a length adjustment assembly attached to a front side of said strap;

wherein said strap is constructed of an elastic material that is resilient and movable between an at-rest configuration and a lengthened configuration, said strap being naturally biased toward said at-rest configuration;

wherein said length adjustment assembly includes:

a first adjustment portion fixedly attached to said front side of said strap that is constructed of loop material;

a second adjustment portion having a first section fixedly attached to said front side and a second section having a proximal edge pivotally coupled to said first section and having a bottom side constructed of a hook material, said second section being pivotally movable between an adjustment configuration in which said second section is displaced from said first adjustment portion and a deployed configuration mated to said first adjustment portion.

2. The method for using a physical therapy band as in claim 1, wherein each said first loop member and said second loop member is a continuous loop of elastic material capable of movement between an at-rest configuration and a stretched configuration.

3. The method for using a physical therapy band as in claim 2, wherein each said first loop member and said second loop member is normally biased toward said at-rest configuration.

4. The method for using a physical therapy band as in claim 1, wherein a front side of said strap includes an indicia area having at least one alphanumeric indicium indicative of advertising content.

5. The method for using a physical therapy band as in claim 1, wherein said strap has a linear configuration having a length for extending between the thumb and the elbow of a person, said strap having a thin construction.

* * * * *